US009156651B2

(12) United States Patent
Park

(10) Patent No.: US 9,156,651 B2
(45) Date of Patent: Oct. 13, 2015

(54) TUBING REEL ASSEMBLY FOR COILED TUBING SYSTEMS

(75) Inventor: DoSeo Park, Houston, TX (US)

(73) Assignee: Stewart & Stevenson, LLC, Houston, TX (US)

( * ) Notice: Subject to any disclaimer, the term of this patent is extended or adjusted under 35 U.S.C. 154(b) by 648 days.

(21) Appl. No.: 13/439,342

(22) Filed: Apr. 4, 2012

(65) Prior Publication Data

US 2012/0247579 A1 Oct. 4, 2012

Related U.S. Application Data

(60) Provisional application No. 61/471,403, filed on Apr. 4, 2011.

(51) Int. Cl.
*B65H 75/44* (2006.01)
*B65H 75/38* (2006.01)

(52) U.S. Cl.
CPC ..... *B65H 75/4478* (2013.01); *B65H 75/38* (2013.01); *B65H 75/4407* (2013.01); *B65H 75/4481* (2013.01); *B65H 75/4486* (2013.01); *B65H 2701/33* (2013.01); *Y10T 137/6954* (2015.04)

(58) Field of Classification Search
CPC .... B65H 2701/33; B65H 75/38; B65H 75/42; B65H 75/4407; B65H 75/4478; B65H 75/4486
USPC ..... 137/355.12, 355.16, 355.2, 355.26, 580
See application file for complete search history.

(56) References Cited

U.S. PATENT DOCUMENTS

| | | | | |
|---|---|---|---|---|
| 3,343,861 | A * | 9/1967 | Sinicki | 294/81.2 |
| 4,945,938 | A * | 8/1990 | Ponsford et al. | 137/15.01 |
| 4,949,909 | A * | 8/1990 | Hatfield | 242/557 |
| 5,139,751 | A * | 8/1992 | Mansfield et al. | 422/292 |
| 5,495,995 | A | 3/1996 | Dominique et al. | |
| 5,598,866 | A * | 2/1997 | Nelson | 137/355.12 |

(Continued)

FOREIGN PATENT DOCUMENTS

| | | |
|---|---|---|
| GB | 668337 | 3/1952 |
| JP | 53-115930 | 9/1978 |

(Continued)

OTHER PUBLICATIONS

International Search Report and The Written Opinion of The International Searching Authority for PCT/US2012/031999, mailed Sep. 7, 2012.

(Continued)

*Primary Examiner* — Kevin Murphy
(74) *Attorney, Agent, or Firm* — Jones Day

(57) ABSTRACT

A tubing reel assembly including a drive assembly, a swivel assembly, a reel, and a stand. The drive assembly includes a drive assembly adapter that connects the reel and the drive assembly, a drive assembly mount that connects the drive assembly and the stand, and a rotational power source. The swivel assembly includes a swivel assembly adapter that connects the reel and the swivel assembly, a swivel assembly mount that connects the swivel assembly and the stand, a bearing, and a hydraulic swivel. The reel includes recessed hubs that allow the overall width of the tubing reel assembly to be reduced, and the recessed hubs are used for connecting the drive assembly to the reel and the swivel assembly to the reel.

18 Claims, 20 Drawing Sheets

(56) References Cited

U.S. PATENT DOCUMENTS

| | | | | |
|---|---|---|---|---|
| 6,352,216 | B1 | 3/2002 | Coats | |
| 6,494,397 | B1 * | 12/2002 | Myklebust | 242/399.1 |
| 6,527,215 | B1 | 3/2003 | Cain et al. | |
| 6,648,000 | B2 | 11/2003 | Cain et al. | |
| 6,672,529 | B2 | 1/2004 | Cain et al. | |
| 7,152,685 | B2 | 12/2006 | Adnan et al. | |
| 7,600,564 | B2 | 10/2009 | Shampine et al. | |
| 2001/0052415 | A1 | 12/2001 | Coats et al. | |
| 2005/0103918 | A1 * | 5/2005 | Bedwell | 242/388.6 |

FOREIGN PATENT DOCUMENTS

| | | | |
|---|---|---|---|
| JP | 7-25549 | | 1/1995 |
| JP | 2000-219436 | | 8/2000 |
| WO | WO 01/34934 | A2 | 5/2001 |
| WO | WO 2005/097648 | A1 | 10/2005 |
| WO | WO 2007/077503 | A2 | 7/2007 |
| WO | WO 2010/019047 | A2 | 2/2010 |

OTHER PUBLICATIONS

Supplemental Partial European Search Report for EP 12767326.

* cited by examiner

TUBING REEL ASSEMBLY FOR COILED TUBING SYSTEMS

CROSS-REFERENCE TO RELATED APPLICATIONS

This application claims priority to provisional application No. 61/471,403, which was filed in the U.S. Patent and Trademark Office on Apr. 4, 2011.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There has been no joint research agreements entered into with any third-parties.

BACKGROUND OF THE EMBODIMENTS OF THE PRESENT INVENTION

1. Field of the Invention

The embodiments of the present invention relate generally to coiled tubing units utilizing a direct drive tubing reel assembly.

2. Description of the Related Art

Oftentimes in the development and production of an oil or gas well, elongated tubing is inserted into the well from the surface for such purposes as the injection of certain types of fluids for stimulation of the production, displacing fluids in the well, for performing cleaning operations on the production tubing, as well as various other purposes. A continuous length of tubing is inserted into the well from a large reel at the surface. In the oil and gas industries, this process is known as coiled tubing.

A coiled tubing reel assembly includes a reel (otherwise known in the industry as a spool or wheel) on which the tubing is spooled, a stand for supporting the reel on which the tubing is stored, a drive system for rotating the reel and creating back-tension during operation of the reel, and a swivel assembly (typically hydraulic) to connect the coiled tubing to a fluid source/hydraulic pumps. The drive system is typically a chain driven system or a direct drive system, each having their own advantages/disadvantages which are commonly known in the industry.

Conventional designs of tubing reel assemblies, such as chain driven tubing reel assemblies and direct drive tubing reel assemblies, have significant issues in reel replacement in the situation where a different size coiled tubing must be used. Specifically, for changing a small-sized coiled tubing to large-sized coiled tubing and vice versa, the bore size of the hydraulic swivel would be an issue because of the sudden area change (expansion or contraction) at the swivel and coiled tubing. To solve these sudden expansion or contraction issues, using a proper size hydraulic swivel that has similar bore size with coiled tubing is preferred. However changing the hydraulic swivel to one with a proper bore size on a conventional tubing reel assembly is often difficult or impossible. Additionally, the tubing reel assembly may have a plumbing issue because the connection is typically located at the inside of the reel.

For the reasons included above, it is therefore an object of embodiments of the present invention to provide a tubing reel assembly that permits easier reel and hydraulic swivel replacement as well as easier maintenance for the entire assembly.

BRIEF SUMMARY OF THE EMBODIMENTS OF THE PRESENT INVENTION

The embodiments of the present invention include a tubing reel assembly including a drive assembly, a swivel assembly, a reel, and a stand. The drive assembly includes a drive assembly adapter that connects the reel and the drive assembly, a drive assembly mount that connects the drive assembly and the stand, and a rotational power source. The swivel assembly includes a swivel assembly adapter that connects the reel and the swivel assembly, a swivel assembly mount that connects the swivel assembly and the stand, a bearing, and a hydraulic swivel. The reel includes recessed hubs that allow the overall width of the tubing reel assembly to be reduced, and the recessed hubs are used for connecting the drive assembly to the reel and the swivel assembly to the reel.

Another embodiment of the present invention is directed to a tubing reel assembly for coiled tubing systems including a drive assembly that includes a direct drive system, a drive assembly adapter, and a drive assembly mount. The tubing reel assembly also includes a swivel assembly including a swivel assembly adapter, a hydraulic swivel, a turntable bearing, and a swivel assembly mount. Additionally, the tubing reel assembly includes a reel having two recessed hubs and a hub plate with a standard shipping hub design, and a stand including a guide mechanism. The swivel assembly adapter connects the swivel assembly to the reel and includes alignment pins, bolt holes with bolts to connect the swivel assembly and the reel, a standard shipping reel hub interface, a pocket to allow for high pressure plumbing to be located outside of the reel, and a bearing mount for the turntable bearing. The swivel assembly mount includes at least two pin holes with alignment pins to connect the swivel assembly to the stand and a cutout disposed at the bottom of the swivel assembly mount for guiding the swivel assembly when assembling the swivel assembly to the stand. The drive assembly adapter includes at least two mount holes and mounts that are used to connect the drive assembly and the reel, and at least two alignment pins. The drive assembly mount includes at least two pin holes with alignment pins to connect the drive assembly to the stand and a cutout disposed at the bottom of the drive assembly mount for guiding the drive assembly when assembling the drive assembly to the stand.

Yet another embodiment of the present invention is directed to a tubing reel assembly for coiled tubing systems including a drive assembly that includes a direct drive system, a drive assembly adapter, and a drive assembly mount. The direct drive system includes a rotational power source, hydraulic quick disconnect (QD) couplings, a planetary gearbox and motor, and a gearbox mount. The tubing reel assembly also includes a swivel assembly that includes a swivel assembly adapter, a hydraulic swivel, a turntable bearing, and a swivel assembly mount. Additionally, the tubing reel assembly includes a reel having two recessed hubs and a hub plate with a standard shipping hub design, and a stand that includes a guide mechanism, a platform, and side mounts, where the side mounts are mounted to the platform and the drive assembly and swivel assembly are supported by the side mounts. The guide mechanism includes telescopic movement of the swivel assembly and the drive assembly. The swivel assembly adapter connects the swivel assembly to the reel, and the swivel assembly adapter further includes at least two alignment pins, bolt holes with bolts to connect the swivel assembly and the reel, a standard shipping reel hub interface, a pocket to allow for high pressure plumbing to be located outside of the reel, and an adapter for the turntable bearing. The swivel assembly mount includes at least two pin holes with alignment pins to connect the swivel assembly to the stand and a cutout located at the bottom of the swivel assembly mount for guiding the swivel assembly when assembling the swivel assembly to the stand. The turntable bearing facilitates the mechanical rotation of at least one ring and its adjoining structure relative to one another. The drive assembly adapter connects the drive assembly to the reel, and the drive assembly adapter further includes at least two bolt holes and bolts to connect the drive assembly and the reel, a standard shipping reel hub interface, and at least two alignment pins. The drive assembly mount includes at least two pin holes with alignment pins to connect the drive assembly to the stand and a cutout located at the bottom of the drive assembly mount for guiding the drive assembly when assembling the drive assembly to the stand.

BRIEF DESCRIPTION OF THE DRAWINGS

Preferred features of embodiments of the present invention are disclosed in the accompanying drawings, wherein similar reference characters denote similar elements throughout the several views, and wherein.

DETAILED DESCRIPTION OF THE EMBODIMENTS OF THE PRESENT INVENTION

Figure 1:
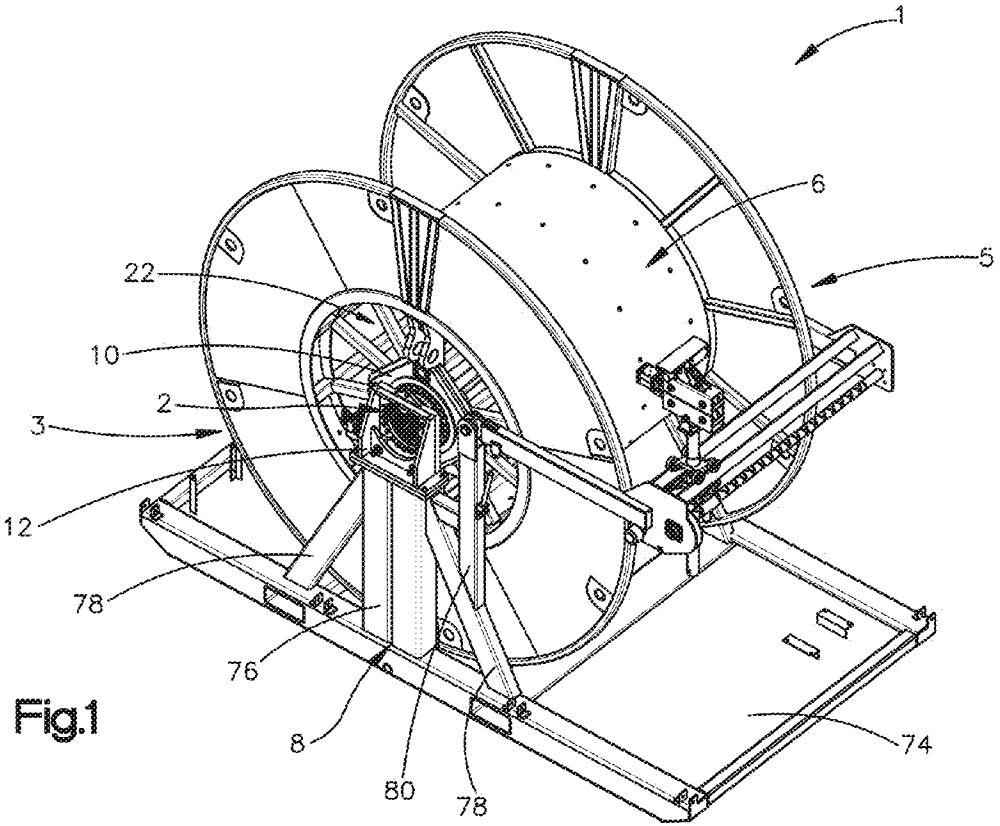
FIG. 1 is front/side perspective view of a tubing reel assembly according to an embodiment of the present invention.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will convey the scope of the invention to those skilled in the art.

In the following description, like reference characters designate like or corresponding parts throughout the figures. Additionally, in the following description, it is understood that terms such as "top," "bottom," "upper," "lower," "left," "right," and the like, are words of convenience and are not to be construed as limiting terms.

Figure 2:
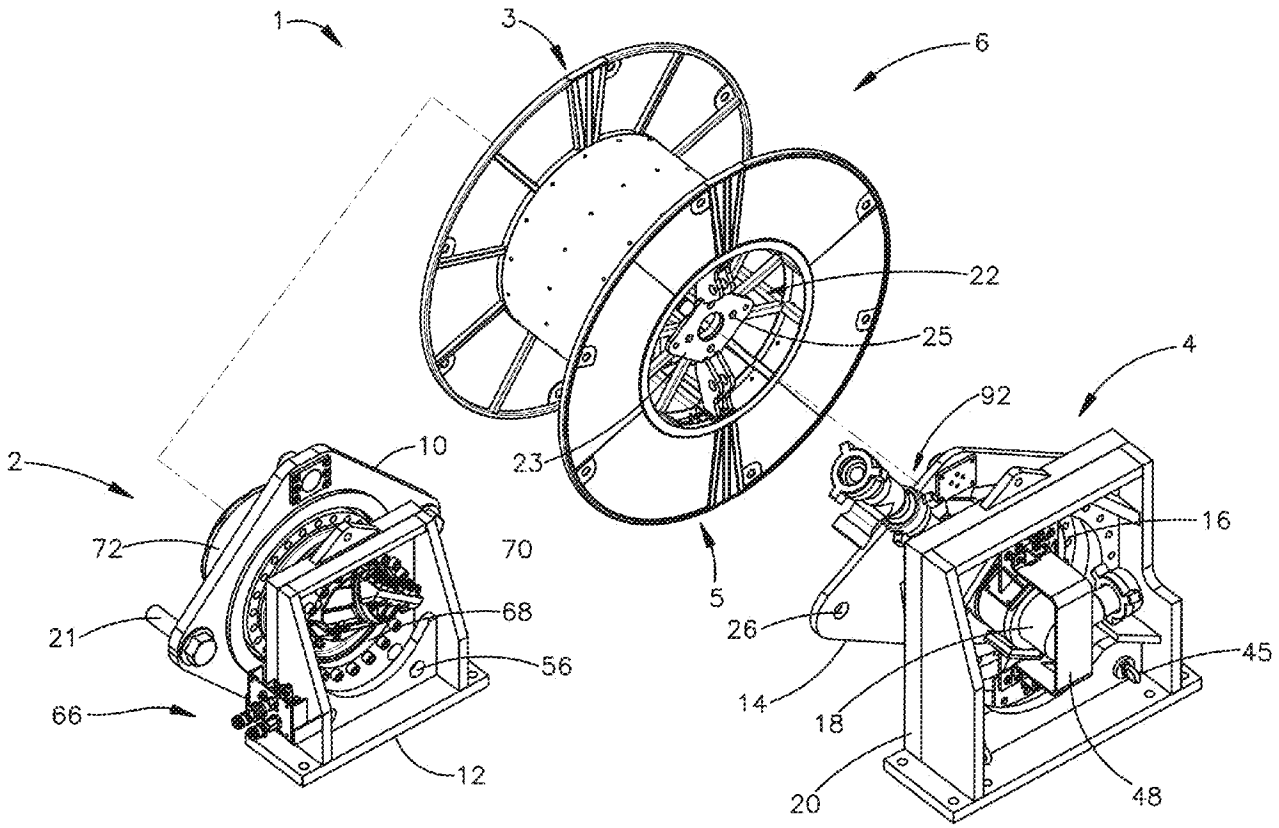
FIG. 2 is an exploded view of a tubing reel assembly according to an embodiment of the present invention.

As depicted in FIGS. 1 and 2, the embodiments of the present invention generally include a direct drive tubing reel assembly 1 including four main components: (i) a drive assembly 2 (direct drive), (ii) a swivel assembly 4, (iii) a reel 6, and (iv) a stand 8. The drive assembly 2 includes an adapter 10 that connects the reel 6 and the drive assembly, a rotational power source, and a mount 12 that connects the drive assembly and the stand 8. The rotational power source may be, for example, a motor and gearbox 68. The swivel assembly 4 includes an adapter 14 that connects the reel 6 and the swivel assembly, a bearing 16, a hydraulic swivel 18, and a mount 20 that connects the swivel assembly and the stand 8. In an embodiment of the present invention, the reel 6 includes a spoolable drum and recessed hubs 22 that allow the overall width of the tubing reel assembly 1 to be reduced. The recessed hubs 22 are used for connecting the drive assembly and the swivel assembly.

Compared to conventional tubing reel assemblies known in the art, the embodiments of the present invention permit easier reel and hydraulic swivel replacement. Additionally, embodiments of the present invention permit easier maintenance of the swivel by using the adapter design described herein. For rapid reel change, the adapter 14 has alignment pins 24 and bolt holes 26. Additionally, in an embodiment of the present invention, the adapter 14 has a pocket 28 to allow for high pressure plumbing 30 to be located at the outside of the reel 6, which increases the convenience and safety of the assembly compared to other reel assemblies that have the high pressure plumbing located on the inside of the reel.

As depicted in FIG. 1, in an embodiment of the present invention, the coiled tubing reel assembly 1 generally includes the reel 6, a stand 8 that may include telescopic movement, a drive assembly 2, and a swivel assembly (not pictured in FIG. 1). The tubing reel assembly 1 includes a drive side 3 and a swivel side 5, where the drive assembly 2 is on the drive side 3 and the swivel assembly 4 is on the swivel side 5.

Figure 17B:
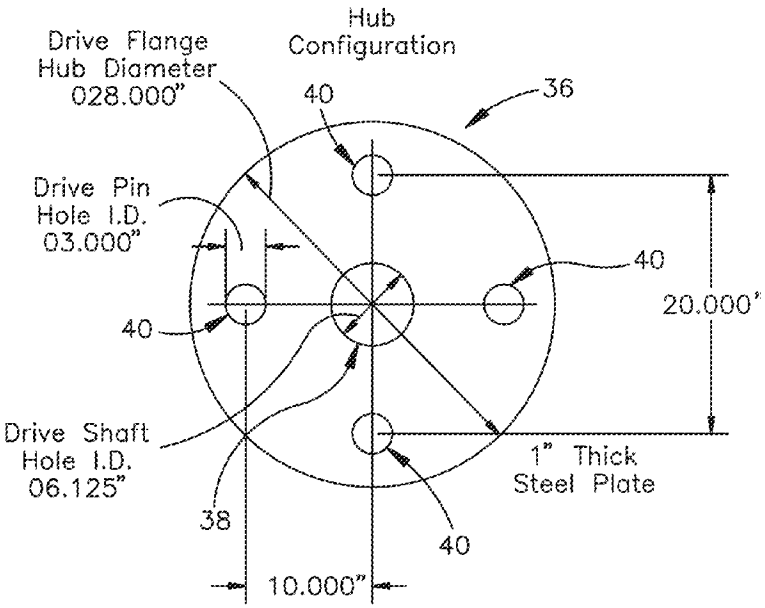
FIG. 17B is detail showing the standard shipping hub design dimensions.
Figure 17A:
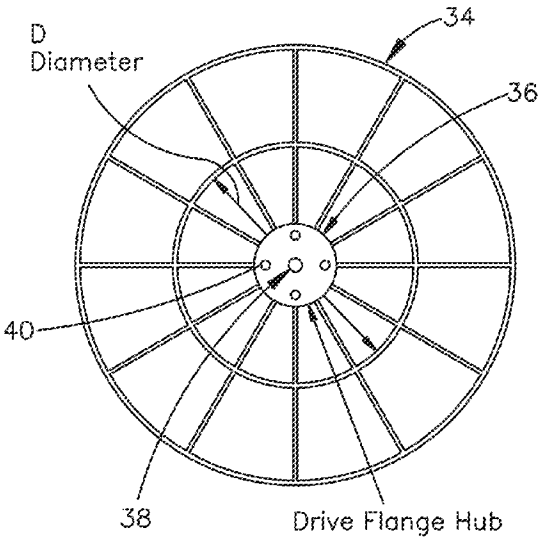
FIG. 17A is front view of a standard shipping hub design on a reel.

FIG. 2 shows the elements of the tubing reel assembly 1 according to an embodiment of the present invention, including the drive assembly 2, the coiled tubing reel 6, and the swivel assembly 4, which are all described in detail below. As stated above, the reel 6 includes recessed hubs 22 for a compact design. Substantially in the center of the recessed hubs 22, the reel 6 includes a hub plate 23 that matches the bolt hole configuration of a standard shipping spool hub design 36 (as shown in FIG. 17A-B). The bolt holes of the adapters align with the bolt holes 25 of the hub plates 23 on the drive side 3 and the swivel side 5 for the mounting of the drive assembly 2 and swivel assembly 4.

The individual components of the embodiments of the present invention will now be discussed in further detail.

Swivel Assembly 4. The swivel assembly 4 is depicted in FIGS. 2, 4-5B, and 10-12. In an embodiment of the present invention, the swivel assembly 4 includes an adapter 14. The adapter 14 has at least two mount holes 26, which may be in the form of bolt holes, that connect the swivel assembly 4 and the reel 6, and at least two alignment pins 24. In an embodiment of the present invention, the swivel assembly 4 further includes a mount 20. The mount 20 has at least two pin holes 44 to connect the swivel assembly 4 and the stand 8 via alignment pins 45. In an embodiment of the present invention, at the bottom of mount 20 there is a cutout 46 for guiding while assembling the swivel assembly 4 and the stand 8. Because of the reduced number of fasteners and guide mechanisms in the embodiments of the present invention, the time to change the reel 6 can be reduced. The embodiments of the present invention further include the high pressure plumbing 30 located on the outside of the reel 6, which promotes easy and safe installation of the tubing reel assembly 1 and the swivel assembly 4. As shown in FIG. 2, in an embodiment of the present invention, the swivel assembly 4 includes a bracket 48 that protects the hydraulic swivel 18. Additionally, the bracket 48 may be used as a handle to ease in maintenance and removal.

Figure 16:
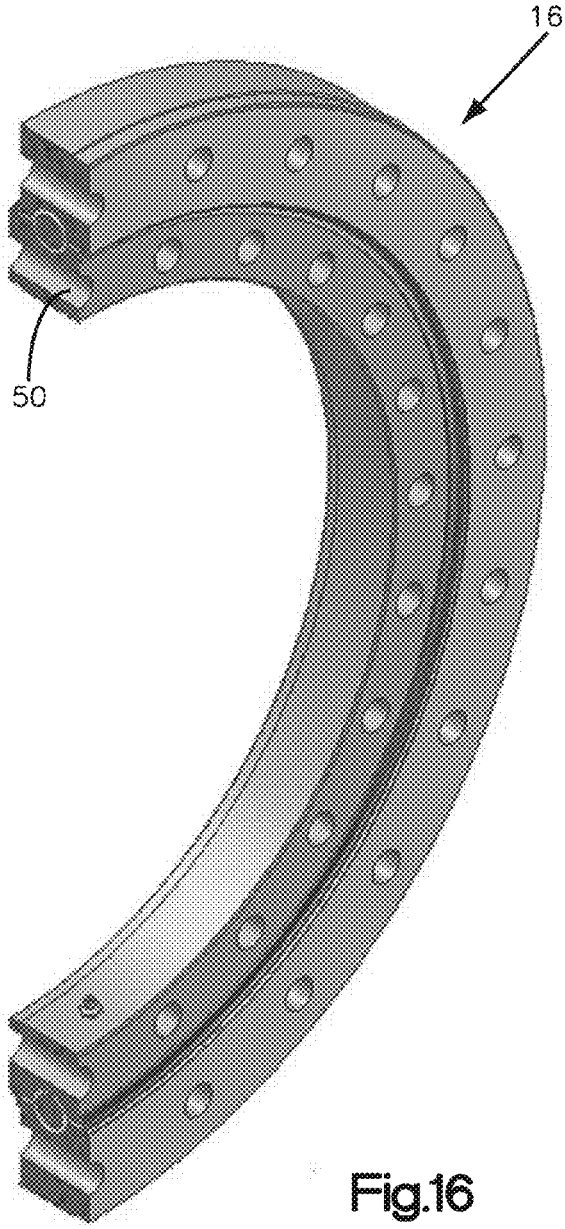
FIG. 16 is a section view of a turntable bearing according to an embodiment of the present invention.

The swivel assembly 4 further includes a bearing 16, which may be in the form of a turntable bearing 16, and a hydraulic swivel 18. In general, a bearing serves as a connection between two adjacent structures, allowing rotation and transmission of a load between them. In addition to satisfying this requirement, in the embodiments of the present invention, the turntable bearing 16 typically includes features for simple and quick attachment to the structures adjacent to the bearing 16. The turntable bearing 16 facilitates the mechanical rotation of at least one ring 50 and its adjoining structure relative to one another. Instead of having a wide overall width, the turntable bearing 16 typically has a large overall outside diameter. A cutaway section of the turntable bearing 16 is shown in FIG. 16.

Figure 4:
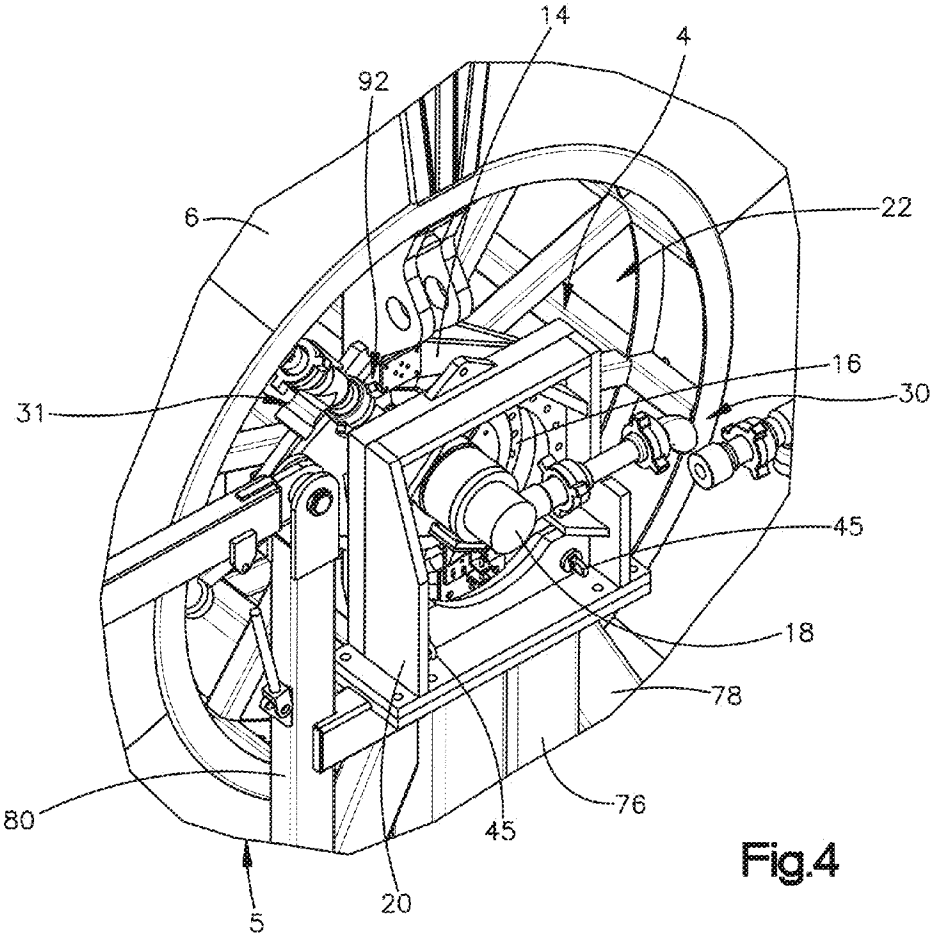
FIG. 4 is a detail showing the swivel side of a tubing reel assembly according to an embodiment of the present invention.
Figure 5A:
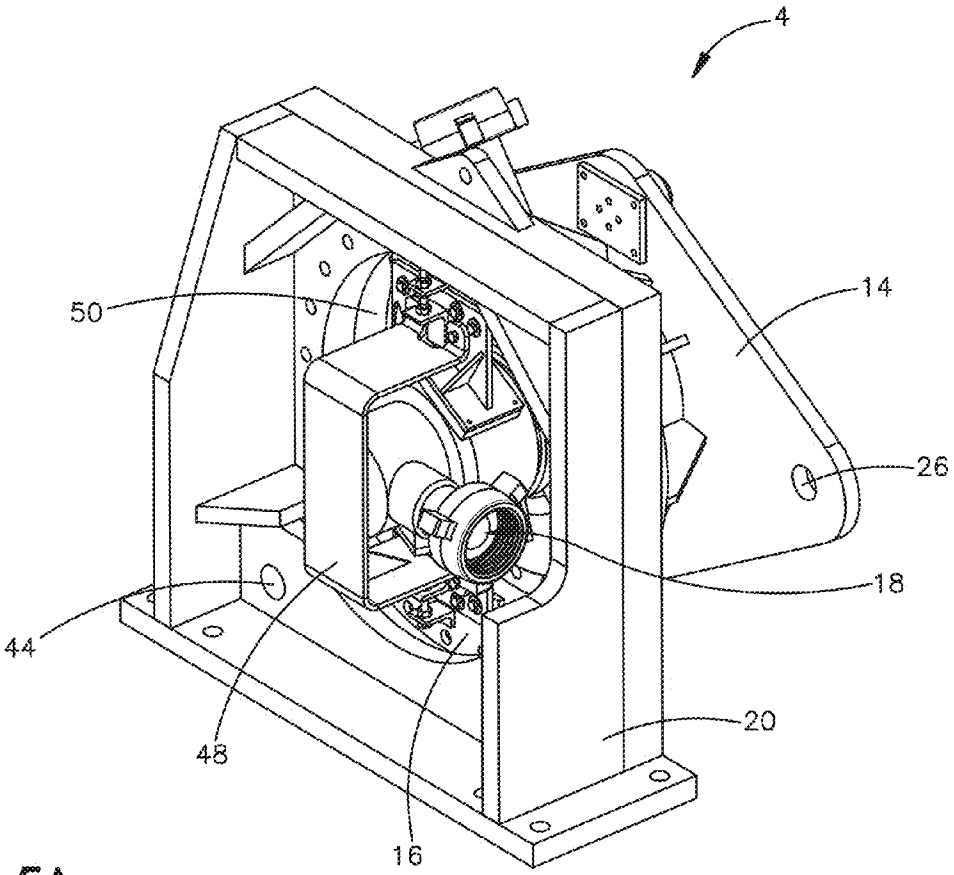
FIG. 5A is a rear/side perspective view of a swivel assembly according to an embodiment of the present invention.
Figure 5B:
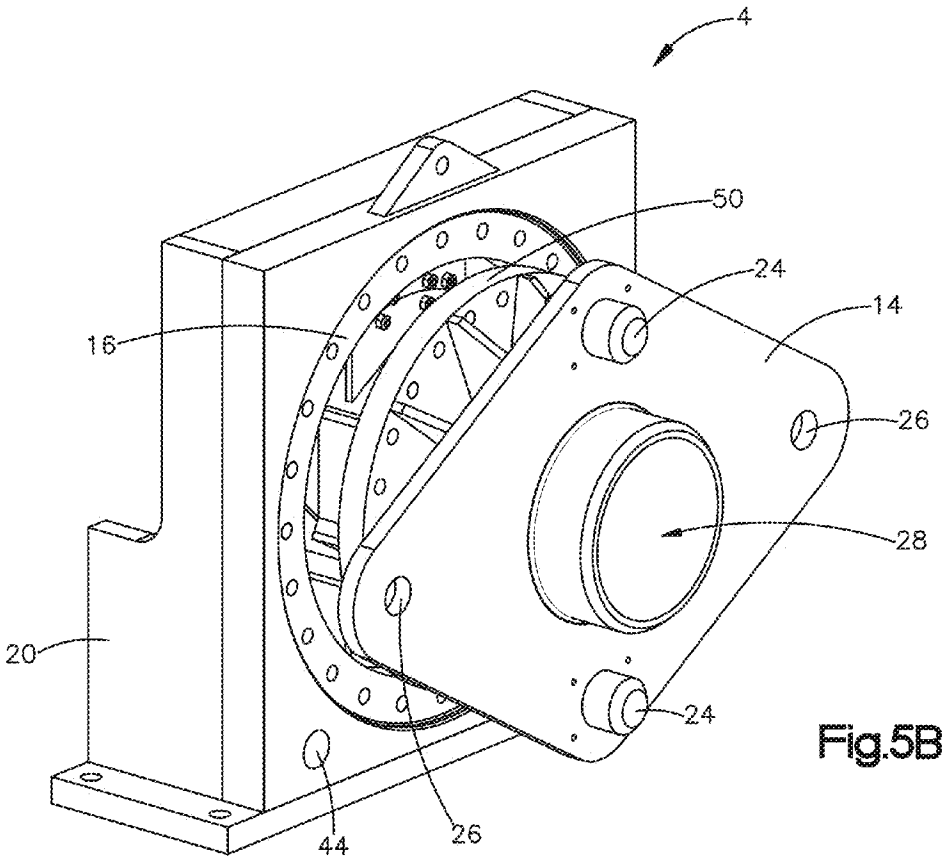
FIG. 5B is a front/side perspective view of a swivel assembly according to an embodiment of the present invention.
Figure 6A:
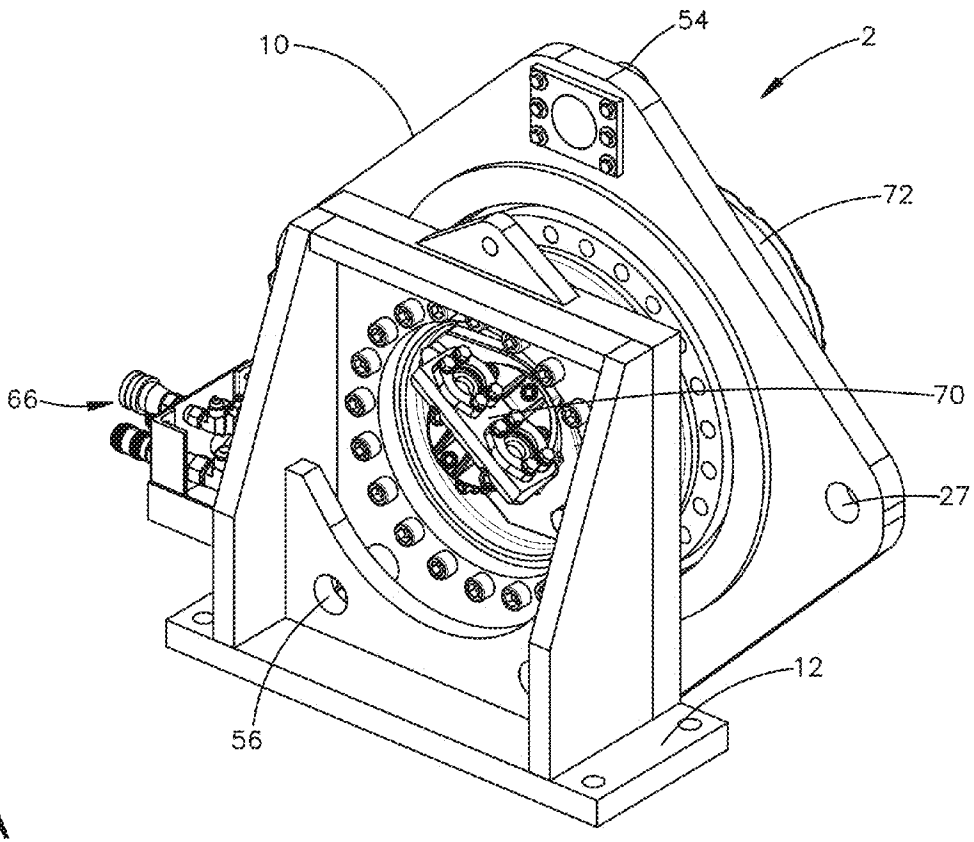
FIG. 6A is right side perspective view of a drive assembly according to an embodiment of the present invention.
Figure 6B:
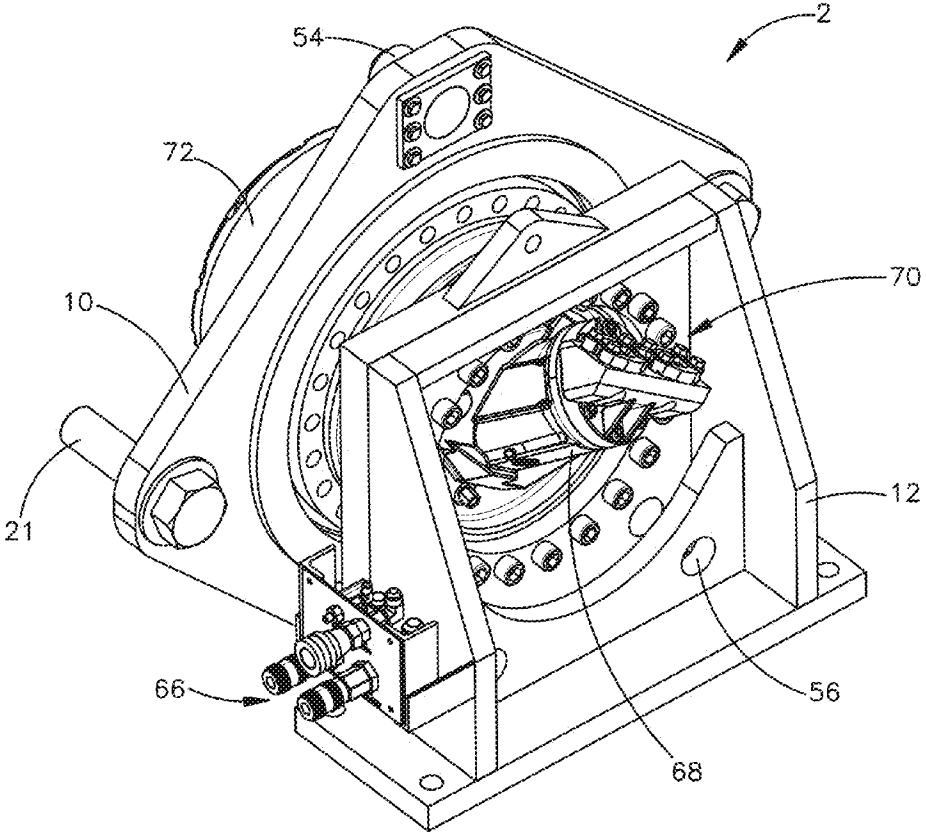
FIG. 6B is a left side perspective view of a drive assembly according to an embodiment of the present invention.

FIG. 4 shows the swivel assembly 4 as part of the tubing reel assembly 1 in an embodiment of the present invention, with the high pressure plumbing 30 located on the exterior of the tubing reel 6. The high pressure plumbing 30 is connected to the hydraulic swivel 18. FIG. 5A depicts the swivel assembly 4 according to an embodiment of the present invention from the perspective of facing the hydraulic swivel 18, where the swivel assembly 4 is not connected to the tubing reel assembly. FIG. 5B shows the swivel assembly 4 according to an embodiment of the present invention from the perspective of facing the adapter 14. The bolt holes 26 of the adapter 14 are clearly depicted in FIG. 5B, along with the turntable bearing 16.

Figure 10:
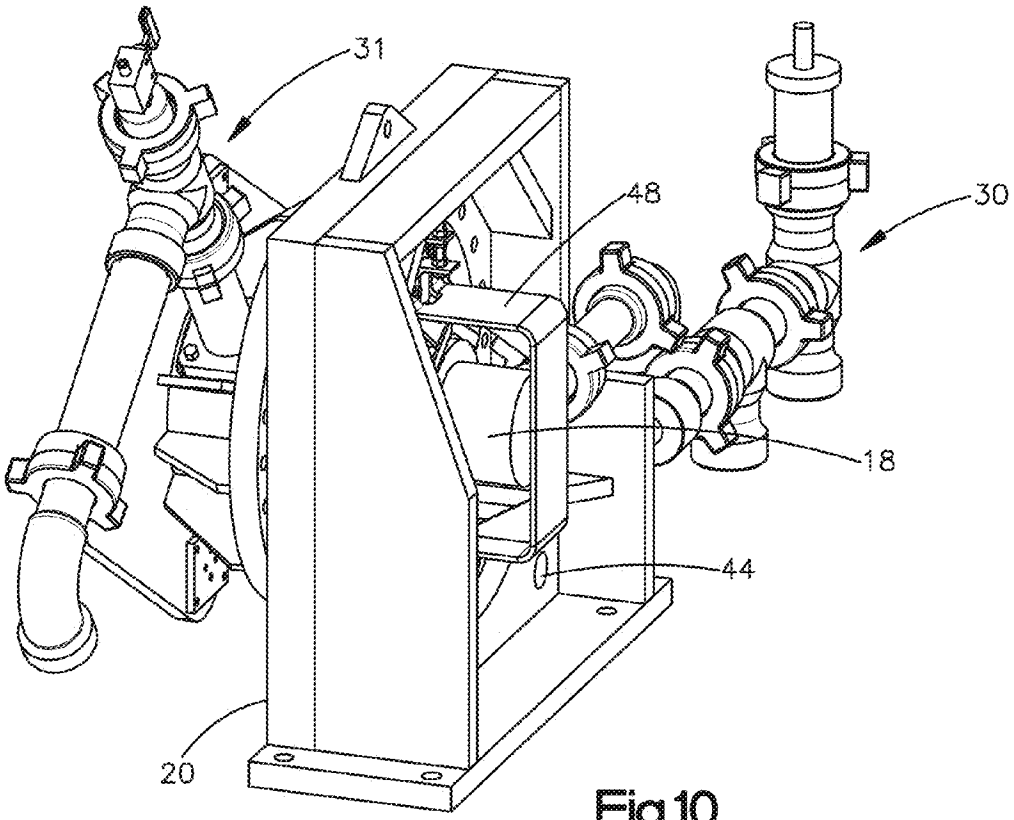
FIG. 10 is a side perspective view showing a hydraulic swivel according to an embodiment of the present invention.
Figure 11A:
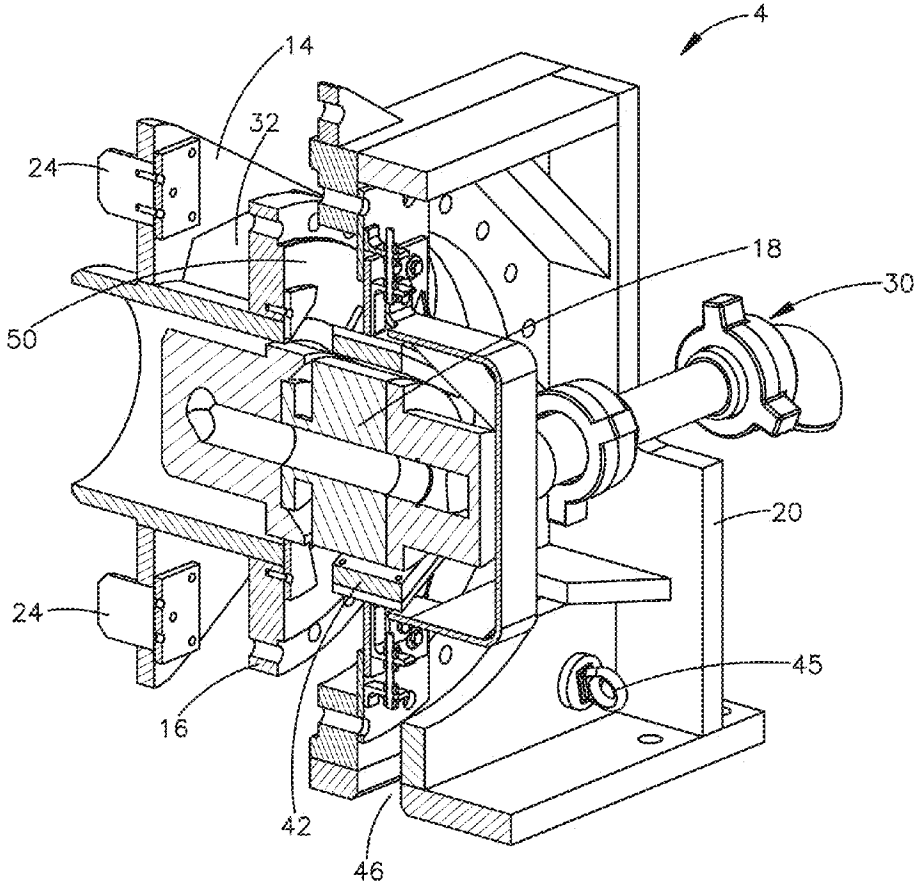
FIG. 11A is a section view of the hydraulic swivel of FIG. 10 according to an embodiment of the present invention.
Figure 11B:
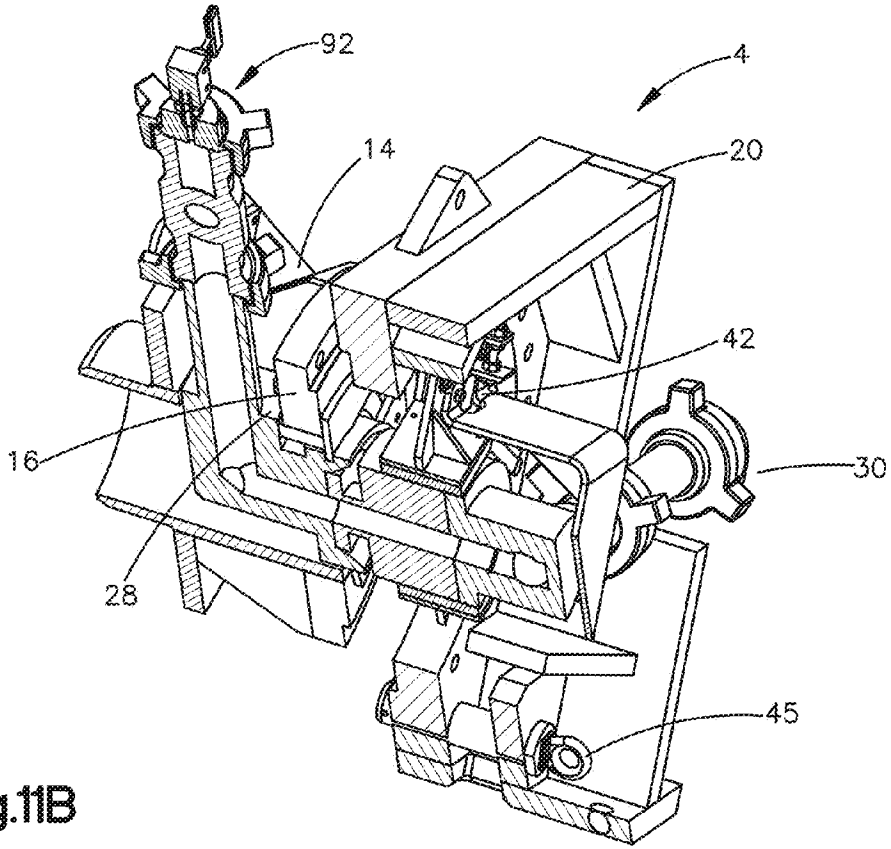
FIG. 11B is a section view of the hydraulic swivel of FIG. 10 at a different angle than FIG. 11A according to an embodiment of the present invention.
Figure 12:
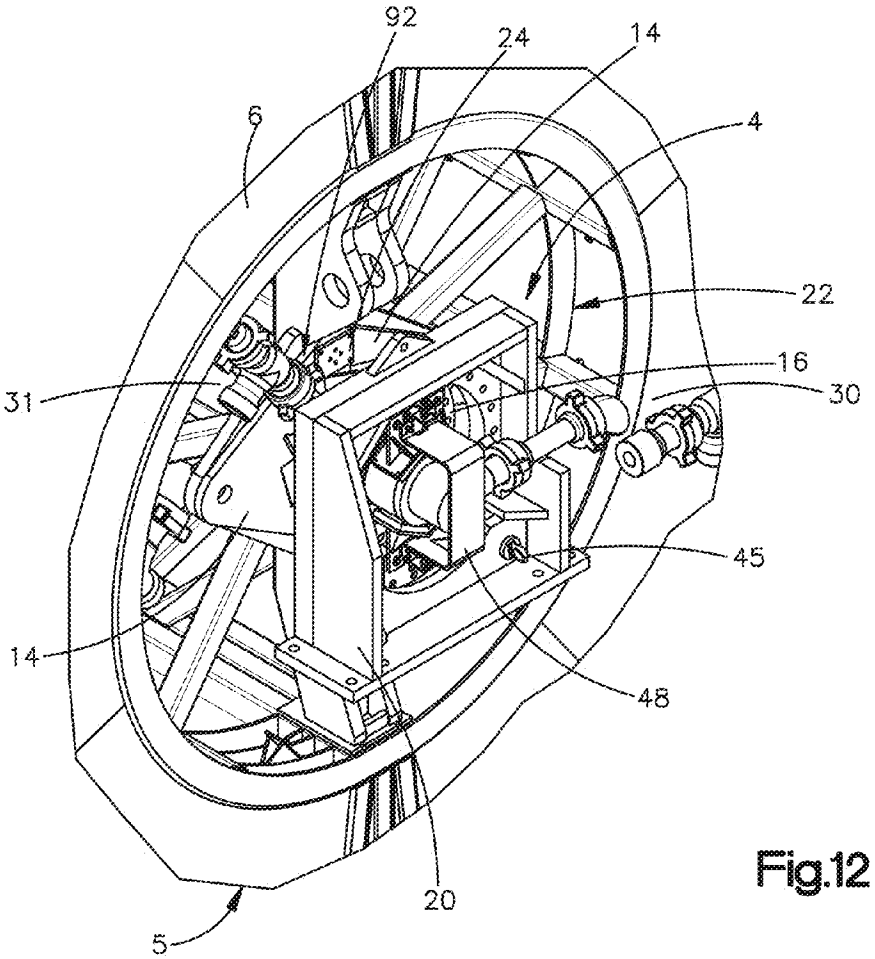
FIG. 12 is a detail showing the swivel side of a tubing reel assembly according to an embodiment of the present invention.

As depicted in FIG. 10, in an embodiment of the present invention, the swivel assembly 4 includes external high pressure plumbing 30 and internal high pressure plumbing 31. The internal components of the swivel assembly 4 include the pocket for a hydraulic swivel 28. FIGS. 11A and 11B are section views of the swivel assembly 4 of FIG. 10 that show the turntable bearing 16, the mount for the hydraulic swivel 42, the hydraulic swivel 18, the adapter 14, and the ring 50. FIG. 12 depicts the swivel assembly 4 of FIGS. 10-11B as part of the tubing reel assembly 1 in the recessed hub 22 of a reel 6.

Drive Assembly 2. The drive assembly 2 is depicted in FIGS. 1-3, 6A, 6B, 13 and 14. The drive assembly 2 in a preferred embodiment of the present invention uses a direct drive system. The direct drive system can resolve some of the problems of a chain system, such as difficulties in changing the reel. In an embodiment of the present invention, the drive assembly 2 includes an adapter 10. The adapter 10 has at least two mount holes 52 that are used to connect the drive assembly 2 and the reel 6, and at least two alignment pins 54. In an embodiment of the present invention, the drive system further includes a mount 12. The mount 12 has at least two pin holes 56 to connect the drive assembly 2 and the stand 8. At the bottom of mount 12, there is a cutout for guiding while assembling the drive assembly 2 and the stand 8. In an embodiment of the present invention, the drive assembly adapter includes a standard shipping reel hub interface. Because of the reduced number of fasteners and guide mechanisms, in the embodiments of the present invention, the time to change the reel can be reduced.

Figure 3:
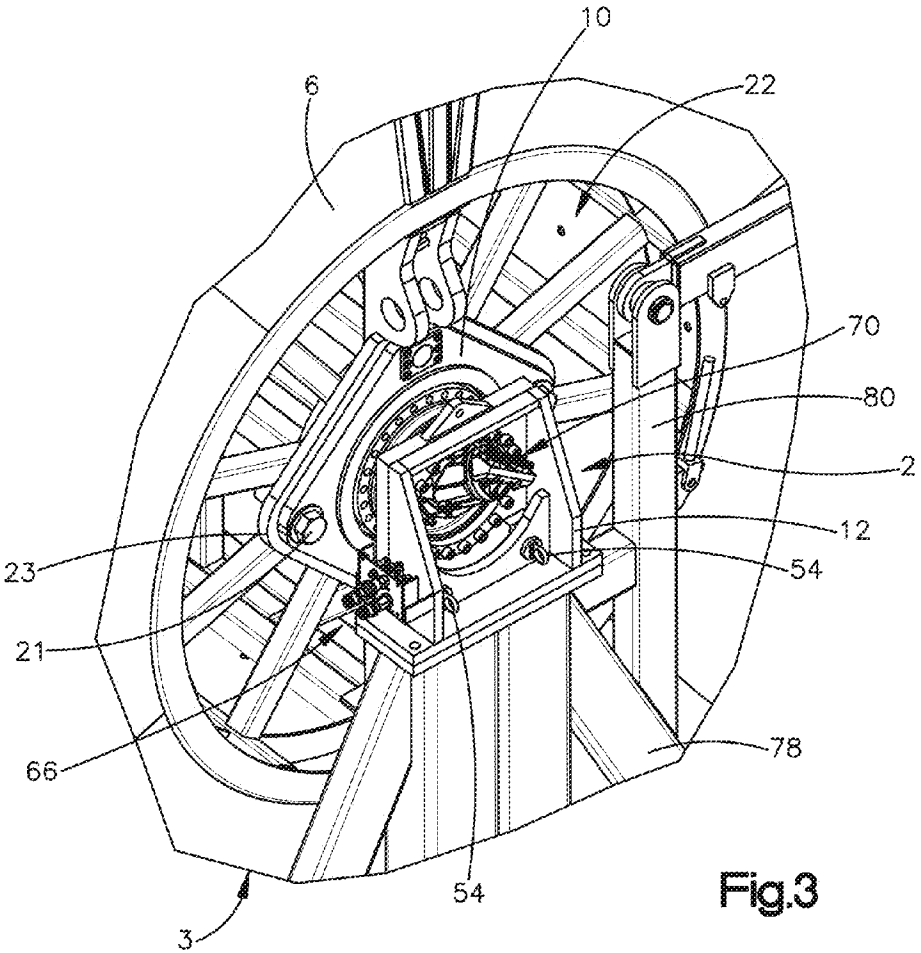
FIG. 3 is a detail showing the drive side of a tubing reel assembly according to an embodiment of the present invention.

As depicted in FIG. 3, in an embodiment of the present invention, the adapter 10 includes connecting bolts 21 for the mounting of the drive assembly 2 to the hub plate 23 of the recessed hubs 22 of the reel 6. The connecting bolts 21 connect the adapter 10 to the hub plate 23 through bolt holes 27, 25 located in the adapter and hub plate, respectively, which align with one another. FIG. 3 clearly depicts mount pins or alignment pins 54, which assist in attaching the mount 12 to the reel 6. Although connecting bolts and alignment pins are described above, alternative fasteners and fastening mechanisms that are known in the art may be used in an alternative embodiment of the present invention. Hydraulic quick disconnect (QD) couplings 66 are located on the side of the mount 12, which are use for connections for the drive assembly 2 system. As depicted in FIGS. 3 and 6, in an embodiment of the present invention, the drive assembly 2 includes a planetary gearbox and motor 68, and a gearbox mount 70.

As stated above, the drive assembly 2 of an embodiment of the present invention includes a rotational power source 72, which may be, for example, a motor and gearbox. The rotational power source 72 can be seen in FIGS. 2, 6A and 6B.

Adapter 10, 14. In an embodiment of the present invention, the swivel assembly adapter 14 has a mount 32 for a turntable bearing 16, which gives the swivel assembly 4 a compact overall width and provides a space for using different bore size hydraulic swivels 18. In the embodiments of the present invention, the turntable bearing 16 typically includes features for simple and quick attachment to the structures adjacent to the bearing 16. The turntable bearing 16 facilitates the mechanical rotation of at least one ring 50 and its adjoining structure relative to one another.

For easy maintenance, the swivel assembly adapter 14 gives the hydraulic swivel 18 independence from the reel 6, which enables users to perform maintenance without removing the reel 6 from the stand 8. Also, in an embodiment of the present invention, the adapter 10, 14 designs have a standard shipping reel hub interface, which allows for the reel 6 to be spooled without a special drive system. FIGS. 17A-B show a standard shipping hub design 36 on a shipping reel 34 and the standard shipping hub design 36 dimensions. A shipping reel 34 is a spool for shipping coiled tubing. The shipping reel 34 has a standard hub configuration 36 that has a drive shaft hole 38 and four drive pin holes 40. The adapter 10, 14 is easily compatible with the shipping reel 34.

Figure 7:
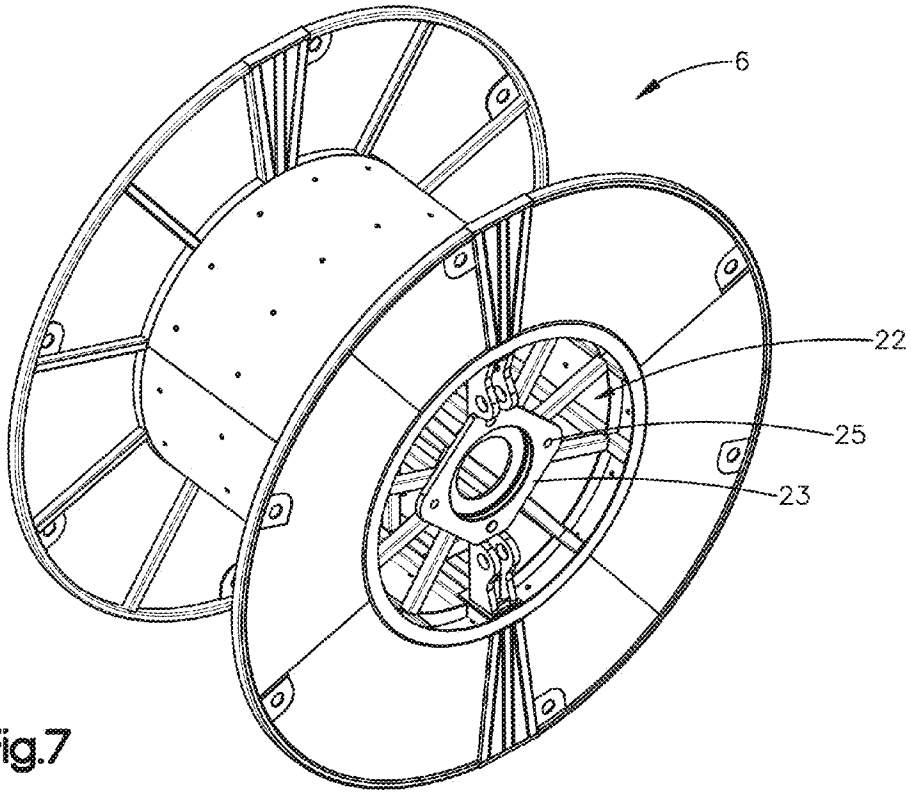
FIG. 7 is a front/side perspective view of a reel according to an embodiment of the present invention.

Reel 6. As depicted in FIGS. 1, 2 and 7, in a preferred embodiment of the present invention, the reel 6 has a spoolable drum and includes two recessed hubs 22 which can reduce the overall width of the assembly. Additionally, the recessed hubs 22 have a standard shipping hub design, which allows the reel 6 to be spooled without a special drive system. FIG. 7 shows the hub plate 23 that matches the bolt hole configuration of a standard shipping spool hub design 36 (as shown in FIG. 17A-B). As stated above, the bolt holes of the adapters align with the bolt holes 25 of the hub plates 23 on the drive side 3 and the swivel side 5 for the mounting of the drive assembly 2 and swivel assembly 4.

Figure 14:
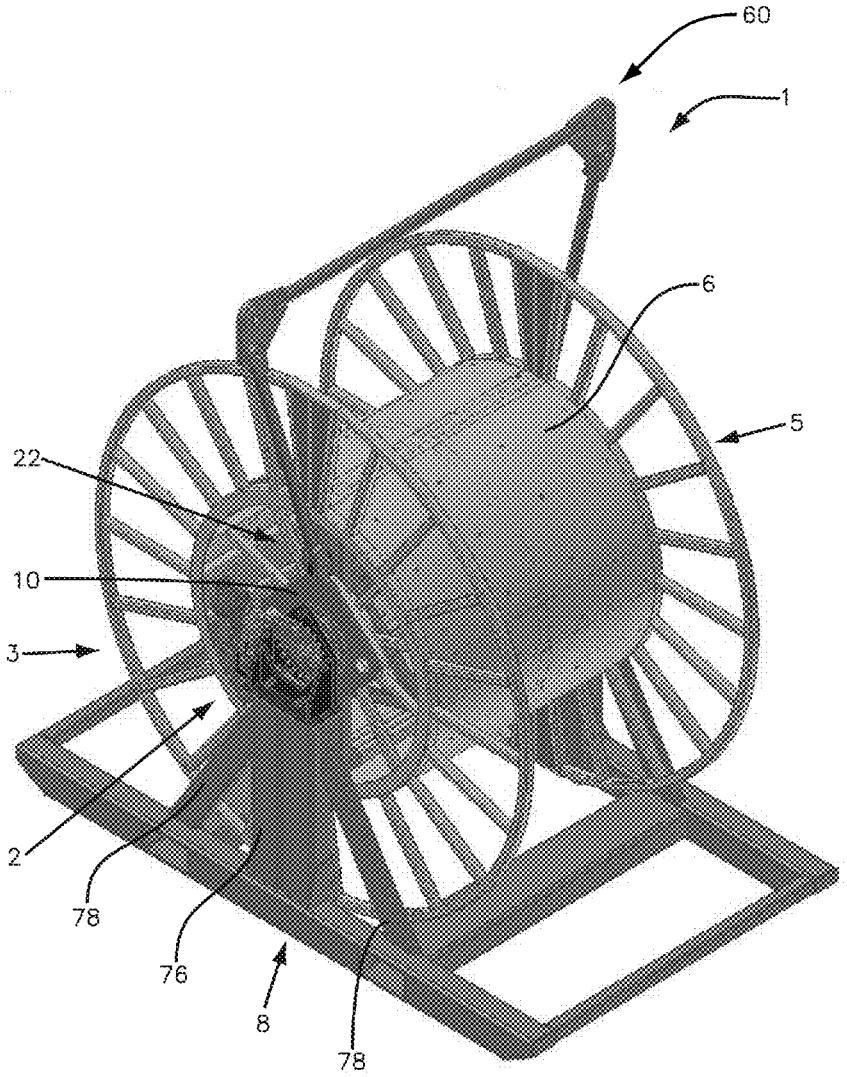
FIG. 14 is front/side perspective view of a tubing reel assembly according to an embodiment of the present invention.
Figure 15:
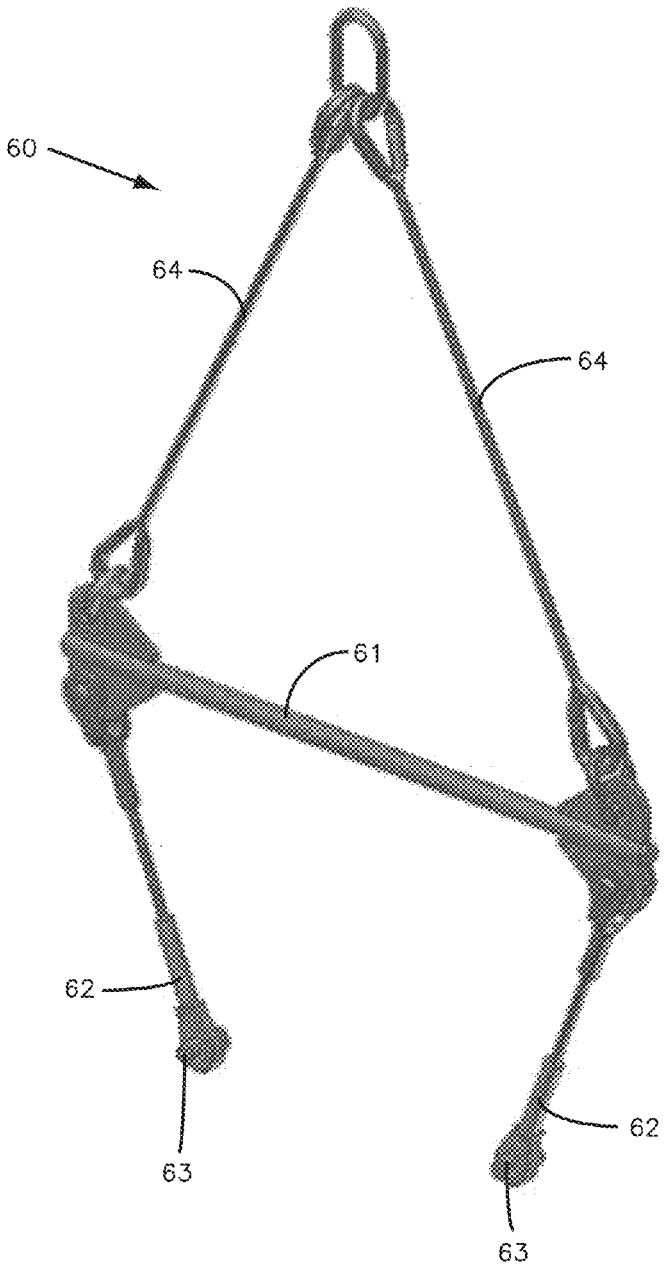
FIG. 15 is a perspective view of the bar assembly that is used in lifting the reel according to an embodiment of the present invention.

Additionally, as depicted in FIG. 14, in an embodiment of the present invention, the reel 6 has a bar 60 that is used in lifting the reel 6. FIG. 15 shows a detail of the bar 60 that includes a spreader bar 61, lower wire rope slings 62 with a closed swage socket 63, and upper wire rope slings 64. In another embodiment of the present invention, the bar assembly is rigid throughout (not pictured).

Figure 8:
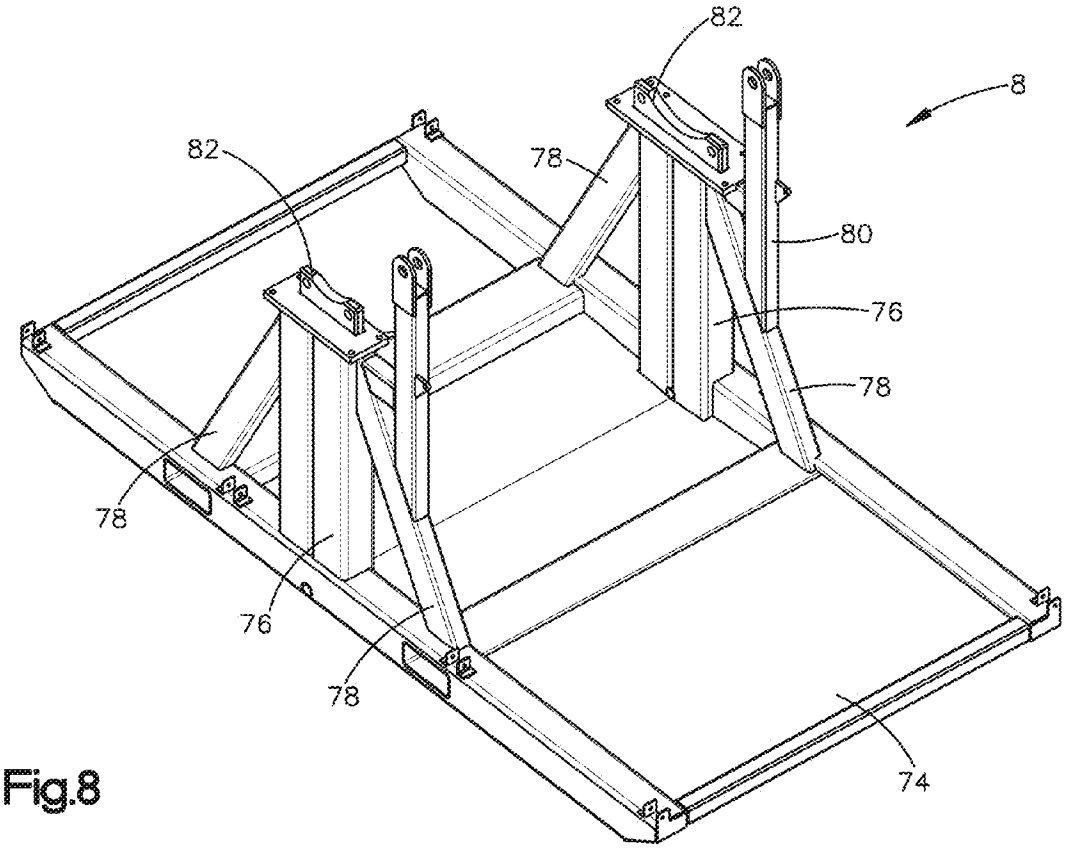
FIG. 8 is a front/side perspective view of a stand according to an embodiment of the present invention.

Stand 8. The stand is shown in FIGS. 1, 8 and 14. In an embodiment of the present invention, the stand 8 has a guide mechanism that promotes faster and easier installation.

In an embodiment of the invention, as depicted in FIG. 8, the stand 8 includes a platform 74, side mounts 76, side mount braces 78, and coiled tubing stabilizer mounts 80. The side mounts 76 hold the drive assembly 2 and swivel assembly 4, and include projections 82 that fit into the cutouts in the swivel assembly and drive assembly mounts 20, 12. The side mounts 76 are supported by the platform 74 and the side mount braces 78. The coiled tubing stabilizer mounts 80 project from the side mount braces 78, and are used to hold the stabilizing bar of the tubing reel assembly 1.

Figure 13:
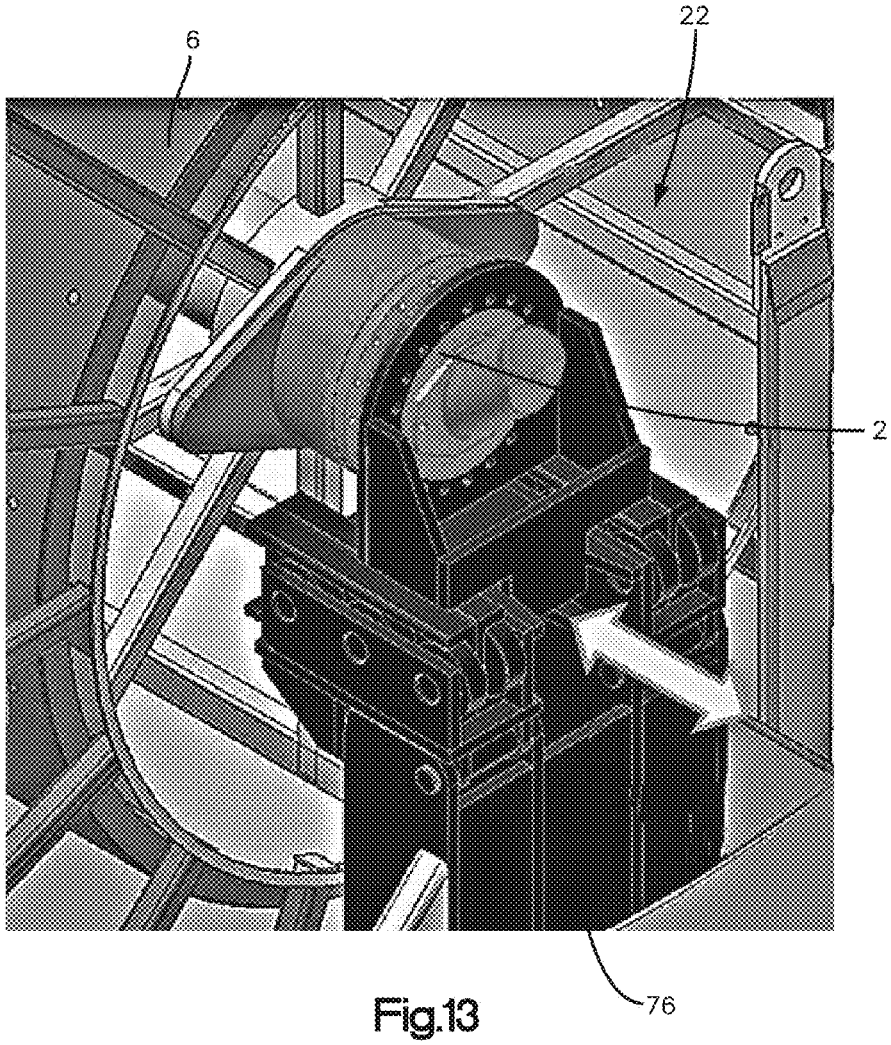
FIG. 13 is a detail showing the drive side of a tubing reel assembly according to an embodiment of the present invention.

As depicted in FIG. 13, in an embodiment of the invention, at least the drive assembly 2 is attached to the stand 8, and the stand 8 includes telescopic movement of at least the drive assembly 2. In another embodiment of the present invention, both the drive assembly 2 and the swivel assembly 4 are attached to the stand 8 and are capable of telescopic movement via a means for telescopic movement. The means for telescopic movement include, but are not limited to, sliders, actuators, hydraulics, roller bearings, boss/slot systems, and the like.

Figure 9:
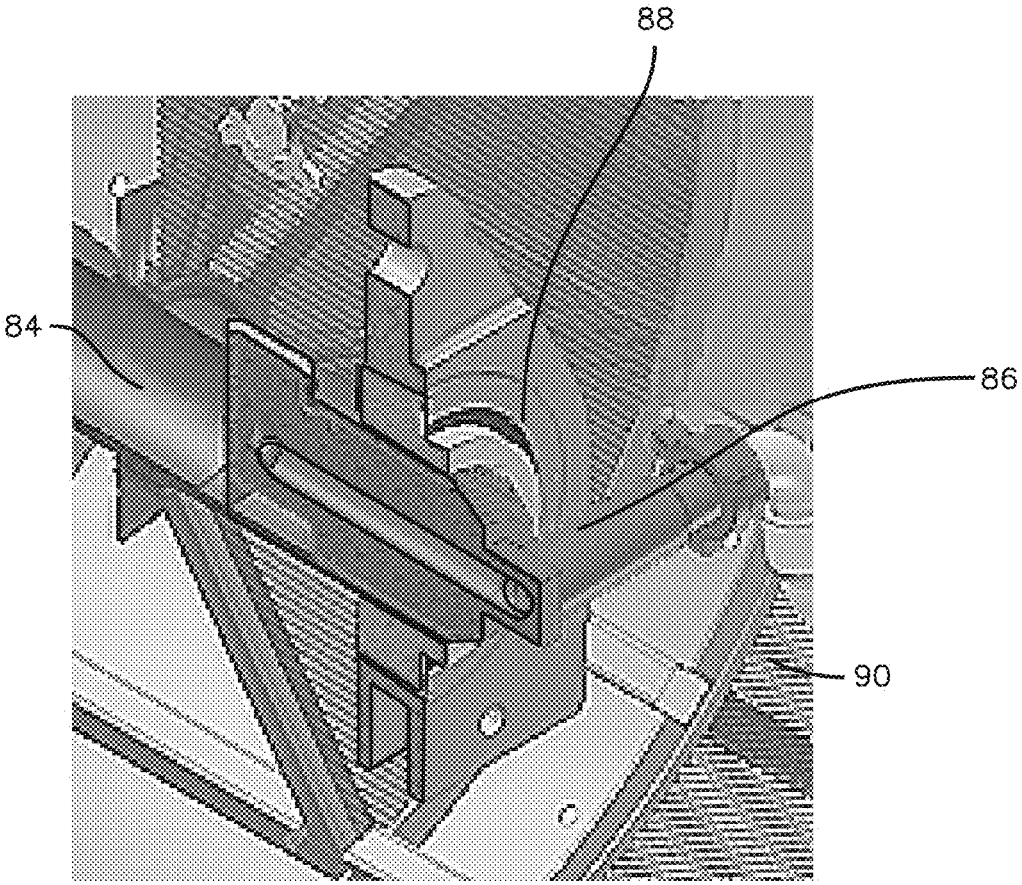
FIG. 9 is a detail showing a conventional tubing reel assembly with a shaft according to the prior art.

FIG. 9 depicts a conventional tubing reel assembly with a shaft 84 where the hydraulic swivel 86 and the bearing 88 are located on the interior of the reel 90. This design has significant issues in reel replacement in the situation where a different size coiled tubing must be used. Changing the hydraulic swivel 86 in this design to one with a proper bore size is difficult or impossible. Additionally, this conventional tubing reel assembly will have a plumbing issue because connections are located at the inside of the reel 90. Conversely, the embodiments of the present invention allow for rapid reel change because the adapter 10, 14 has alignment pins 24, 54 and bolt holes 26, 56. Additionally, the swivel adapter 14 has a pocket 28 to allow high pressure plumbing 30 (which is otherwise typically internal) to be located outside of the reel 6 that allows for easy and safe access, as well as safer operation as compared to the reel assemblies of the prior art which have the internal high pressure plumbing located inside of the reel. The embodiments of the present invention further include a mount 20 for a turntable bearing 16 that gives a compact overall width to the swivel assembly 4. The mount 20 for a turntable bearing 16 also gives the tubing reel assembly 1 space for using hydraulic swivels with different bore sizes without having to change any components. For easier maintenance, the adapter 14 gives the swivel assembly 4 independence from the reel 6, which enables users to perform maintenance without removing the reel 6 from the stand 8. Additionally, in an embodiment of the present invention, because the adapter 10, 14 design has a standard shipping reel hub interface, the reel 6 can be spooled without a special drive system.

As depicted in FIG. 13, an alternate embodiment of the present invention includes a tubing reel assembly having a stand 8 that includes telescopic movement. The telescopic movement can allow for the connection of the drive assembly 2 and the swivel assembly 4 to the reel 6 with recessed hubs 22, while the drive assembly 2 and the swivel assembly 4 remain on the stand 8.

The embodiments of the present invention can be used in any type of reel system.

The reel change procedure for an embodiment of the present invention will now be described.

The first step in the reel change procedure is removing the mount pins 54 and disconnecting the couplings 66, which are preferably quick-disconnect (QD) couplings, from the drive side 3 of the assembly 1. The second step in the reel change procedure is removing the mount pins 24 and disconnecting the high-pressure (HP) plumbing 30 from the swivel side 5 of the assembly 1. The third step in the reel change procedure is lifting the tubing reel 6. The fourth step in the reel change procedure is placing the tubing reel 6 on the ground. The fifth step in the reel change procedure is removing the bolts and nuts from the drive side 3 of the assembly 1. The sixth step in the reel change procedure is removing the gear box 68 from the tubing reel 6. The seventh step in the reel change procedure is disconnecting the HP plumbing 30 (including disconnecting the hammer union 92). The eighth step in the reel change procedure is removing the swivel assembly 4 from the tubing reel 6.

LIST OF REFERENCE NUMBERS INCLUDED IN FIGURES

The following is a list of reference numbers used in the attached figures for embodiments of the present invention.

(1) Tubing Reel Assembly
(2) Drive Assembly
(3) Drive Side
(4) Swivel Assembly
(5) Swivel Side
(6) Reel
(8) Stand
(10) Drive Assembly Adapter
(12) Drive Assembly Mount
(14) Swivel Assembly Adapter
(16) Bearing
(18) Hydraulic Swivel
(20) Swivel Assembly Mount
(21) Connecting Bolts
(22) Recessed Hubs
(23) Hub Plate
(24) Alignment Pins
(25) Bolt Holes
(26) Bolt Holes
(27) Bolt Holes
(28) Pocket
(30) External High Pressure Plumbing
(31) Internal High Pressure Plumbing
(32) Adapter Mount for Turntable Bearing
(34) Standard Shipping Spool
(36) Standard Hub
(38) Drive Shaft Hole
(40) Drive Pin Holes
(42) Mount for Hydraulic Swivel -continued LIST OF REFERENCE NUMBERS INCLUDED IN FIGURES
The following is a list of reference numbers used in the attached figures for embodiments of the present invention.

(44) Pin Holes
(45) Alignment Pins
(46) Cutout
(48) Bracket
(50) Ring
(52) Drive Assembly Mount Holes
(54) Alignment Pins
(56) Pin Holes
(60) Bar
(62) Lower Wire Rope Slings
(63) Closed Swage Socket
(64) Upper Wire Rope Slings
(66) Couplings
(68) Planetary Gearbox and Motor
(70) Gearbox Mount
(72) Rotational Power Source
(74) Platform
(76) Side Mounts
(78) Side Mount Braces
(80) Coiled Tubing Stabilizer Mounts
(82) Projections
(84) Shaft (Conventional)
(86) Hydraulic Swivel (Conventional)
(88) Bearing (Conventional)
(90) Reel (Conventional)
(92) Hammer Union

I claim:

1. A tubing reel assembly comprising:
a drive assembly;
a swivel assembly;
a reel; and
a stand,
wherein the drive assembly comprises a drive assembly adapter that connects the reel and the drive assembly, a drive assembly mount that connects the drive assembly and the stand, and a rotational power source,
wherein the swivel assembly comprises a swivel assembly adapter that connects the reel and the swivel assembly, a swivel assembly mount that connects the swivel assembly and the stand, a bearing, and a hydraulic swivel, and
wherein the reel comprises recessed hubs that allow the overall width of the tubing reel assembly to be reduced, and wherein the recessed hubs are used for connecting the drive assembly to the reel and the swivel assembly to the reel,
wherein the drive assembly adapter further comprises at least two mount holes with mounts that are used to connect the drive assembly and the reel, and at least two alignment pins; and the drive assembly mount further comprises at least two pine holes with alignment pins to connect the drive assembly to the stand.

2. The tubing reel assembly according to claim 1, wherein the recessed hubs comprise a hub plate comprising a shipping hub design.

3. The tubing reel assembly according to claim 2, wherein the bearing is a turntable bearing, and the swivel assembly adapter further comprises an adapter for a turntable bearing and a shipping reel hub interface.

4. The tubing reel assembly according to claim 1, further comprising a cutout disposed at the bottom of the swivel assembly mount for guiding the swivel assembly when assembling the swivel assembly to the stand.

5. The tubing reel assembly according to claim 1, further comprising a cutout disposed at the bottom of the drive assembly mount for guiding the drive assembly when assembling the drive assembly to the stand.

6. The tubing reel assembly according to claim 1, wherein the reel comprises a bar that is used for lifting the reel.

7. The tubing reel assembly according to claim 6, wherein the bar comprises a spreader bar, lower wire rope slings with a closed swage socket, and upper wire rope slings.

8. The tubing reel assembly according to claim 1, wherein the stand comprises a platform and side mounts, and wherein the side mounts are mounted to the platform and the drive assembly and swivel assembly are supported by the side mounts.

9. The tubing reel assembly according to claim 8, wherein the stand further comprises a guide mechanism comprising telescopic movement of the swivel assembly and the drive assembly.

10. A tubing reel assembly comprising:
a drive assembly;
a swivel assembly;
a reel; and
a stand,
wherein the drive assembly comprises a drive assembly adapter that connects the reel and the drive assembly, a drive assembly mount that connects the drive assembly and the stand, and a rotational power source,
wherein the swivel assembly comprises a swivel assembly adapter that connects the reel and the swivel assembly, a swivel assembly mount that connects the swivel assembly and the stand, a bearing, and a hydraulic swivel,
wherein the reel comprises recessed hubs that allow the overall width of the tubing reel assembly to be reduced, and wherein the recessed hubs are used for connecting the drive assembly to the reel and the swivel assembly to the reel, and
wherein the swivel assembly adapter further comprises at least two mount holes with mounts that are used to connect the swivel assembly and the reel, and at least two alignment pins; and the swivel assembly mount further comprises at least two pin holes with alignment pins to connect the swivel assembly to the stand.

11. The tubing reel assembly according to claim 10, wherein the recessed hubs comprise a hub plate comprising a shipping hub design.

12. The tubing reel assembly according to claim 11, wherein the bearing is a turntable bearing, and the swivel assembly adapter further comprises an adapter for a turntable bearing and a shipping reel hub interface.

13. The tubing reel assembly according to claim 10, further comprising a cutout disposed at the bottom of the swivel assembly mount for guiding the swivel assembly when assembling the swivel assembly to the stand.

14. The tubing reel assembly according to claim 10, further comprising a cutout disposed at the bottom of the drive assembly mount for guiding the drive assembly when assembling the drive assembly to the stand.

15. The tubing reel assembly according to claim 10, wherein the reel comprises a bar that is used for lifting the reel.

16. The tubing reel assembly according to claim 15, wherein the bar comprises a spreader bar, lower wire rope slings with a closed swage socket, and upper wire rope slings.

17. The tubing reel assembly according to claim 10, wherein the stand comprises a platform and side mounts, and wherein the side mounts are mounted to the platform and the drive assembly and swivel assembly are supported by the side mounts.

18. The tubing reel assembly according to claim 17, wherein the stand further comprises a guide mechanism comprising telescopic movement of the swivel assembly and the drive assembly.

* * * * *